United States Patent [19]

Mayer

[11] 4,267,892

[45] May 19, 1981

[54] POSITIONING CONTROL SYSTEM FOR ROCK DRILL SUPPORT APPARATUS

[75] Inventor: James R. Mayer, Englewood, Colo.

[73] Assignee: Cooper Industries, Inc., Houston, Tex.

[21] Appl. No.: 34,211

[22] Filed: Apr. 30, 1979

[51] Int. Cl.[3] ..... E21C 1/00; F15B 15/00

[52] U.S. Cl. ..... 173/43; 91/171; 173/2

[58] Field of Search ..... 173/2, 42, 43, 38; 91/171; 182/2

[56] References Cited

U.S. PATENT DOCUMENTS

| | | | |
|---|---|---|---|
| 3,374,975 | 3/1968 | Bronder | 173/38 X |
| 3,481,409 | 12/1969 | Westerlund | 173/43 |
| 3,997,062 | 12/1976 | Hassall et al. | 91/171 X |
| 4,037,671 | 7/1977 | Kimber et al. | 173/2 |

FOREIGN PATENT DOCUMENTS

| | | | |
|---|---|---|---|
| 2000073 | 1/1979 | United Kingdom | 173/2 |

*Primary Examiner*—Wm. Carter Reynolds
*Attorney, Agent, or Firm*—Michael E. Martin

[57] ABSTRACT

In a pivotally mounted rock drill boom and feed bar apparatus the boom and the feed bar positioner include angle sensors comprising cam actuated fluid pressure regulating valves. The pressure regulating valves are disposed in a control circuit which includes a pilot pressure fluid actuated control valve which senses an unbalanced pressure signal generated by one of the sensors in response to pivotal movement of the boom. The control valve responds to the unbalanced pressure condition by valving pressure fluid to the feed bar positioner actuator to maintain the feed bar in a predetermined directional attitude. The angle sensor responsive to pivotal movement of the boom may be adjusted independent of movement of the boom to cause a change in the directional attitude of the feed bar as desired.

5 Claims, 13 Drawing Figures

POSITIONING CONTROL SYSTEM FOR ROCK DRILL SUPPORT APPARATUS

BACKGROUND OF THE INVENTION

The present invention pertains to a positioning control system for maintaining the feed bar of a rock drill apparatus in a predetermined directional attitude when the feed bar suppporting member is moved from one position to another.

In the art of rock drilling it is often desirable to drill a series of blast holes in a particular pattern in order to facilitate efficient rock breakage and removal and to maintain the shape of a tunnel bore or quarry wall. Drill hole patterns wherein a number of holes are drilled parallel to each other are common. Accordingly, it is desirable to be able to rapidly and accurately position the drill feed bar to assure that each hole, as it is drilled, is parallel to the other holes.

To this end a number of inventions have been developed for use with movable drill boom and feed bar apparatus with the intended purpose of positioning the feed bar in response to movement of the boom to maintain the drilling axis parallel to previously drilled holes as well as at a predetermined directional attitude with respect to the rock face.

U.S. Pat. No. 3,374,975 to H. Bronder discloses an arrangement of parallelogram linkages associated with the boom. The above mentioned patent also discloses an arrangement of flow connected actuators associated with the boom and the positioner device for the feed bar. The disadvantages of the above mentioned devices include those of excess weight and limited range of movement, particularly for the mechanical linkage arrangement. Moreover, the flow connected actuators are susceptible to positioning errors due to fluid leakage and geometric considerations.

U.S. Pat. No. 3,481,409 to B. A. Westerlund discloses a parallel positioning system including electrical sensors mounted on the boom pivots and the pivots of the feed bar positioner mechanism. Such electrical devices are generally unsuited for the harsh operating environment of rock drilling equipment. Moreover, it is advantageous to provide control systems which are as simple and easily maintained as possible and which are similar in character with the type of equipment with which such control systems are used. These desirable features of a parallel positioning control system are provided for with the invention disclosed and claimed herein.

SUMMARY OF THE INVENTION

The present invention provides an improved positioning control system for a pivotally mounted rock drill feed and boom apparatus wherein pressure fluid operated angular position sensors are interposed in a fluid control circuit for operating the positioning actuators of the feed bar positioner in response to actuation of the boom positioning actuators.

The positioning control system of the present invention provides for controlling the movement of the feed bar independent of movement of the boom through operation of the boom pivot angular position sensors to simulate pivotal movement of the boom. Accordingly, manually actuated values and accompanying conduits are not required for moving the feed bar independent of movement of the boom.

The present invention also provides for a positioning control system for a rock drill boom and feed bar apparatus wherein remote controls for adjusting the angular position sensors include a locking mechanism to prevent unwanted adjustment of the position of the feed bar with respect to the boom.

The positioning control system of the present invention is further characterized by angular position sensors which provide an unbalanced fluid pressure signal to a control valve or valves in response to movement of the pivotally mounted drill boom. The control valve operates to provide pressure fluid to the feed bar positioner actuator until angular position sensors at the positioner pivots provide a balancing pressure fluid signal to the control valve so that the feed bar is moved through an angular increment corresponding to the angular movement of the boom.

DESCRIPTION OF THE PREFERRED EMBODIMENT

Figures 1, 2:
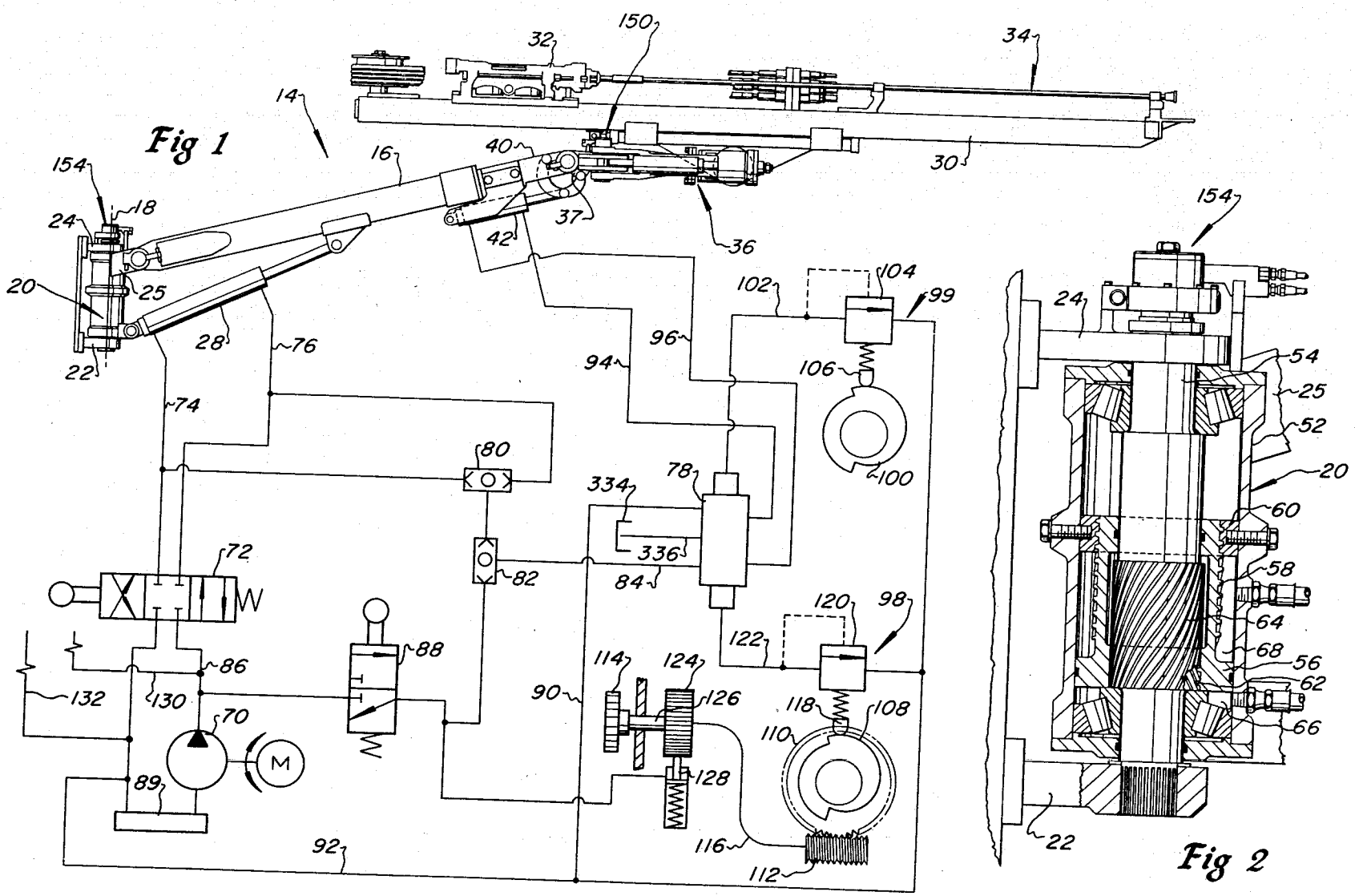
FIG. 1 is a side elevation of a rock drill boom and feed apparatus which is adapted to use the positioning control system which is also shown diagrammatically, in part.
FIG. 2 is a section view of the boom swing actuator used with the rock drill boom shown in FIG. 1.

Referring to FIG. 1 the positioning control system of the present invention is adapted to be used on a rock drill boom and feed bar apparatus generally designated by the numeral 14. The apparatus 14 includes an elongated boom 16 which is mounted for movement about a vertical axis formed by a rotary swing actuator 20. The swing actuator 20 is adapted to be mounted in spaced apart supports 22 and 24 which may be fixed to further structure such as the frame of a mobile drilling rig, not shown. The boom 16 is also movable about a horizontal pivot axis formed by a clevis 25 on the actuator 20 and a suitable pivot pin 26, shown in part in FIG. 8. The boom 16 is moved about the aforementioned horizontal pivot axis by an extensible hydraulic cylinder and piston type actuator 28 connected to the boom and the rotary swing actuator 20.

The distal end of the boom 16 is adapted to support an elongated drill feed bar 30 on which a pressure fluid actuated percussion rock drill 32 is slidably mounted. The drill 32 is operable to transmit rotary and percussive energy to a drill stem and bit assembly 34. The feed bar 30 is mounted on a positioning mechanism 36 which includes a member 37 which is pivotally connected to the boom 16 for movement about a horizontal pivot axis formed by a pivot pin 38, shown in part in FIG. 6, and which is rotatably supported by a clevis bracket 40. The bracket 40 may be suitably connected directly to the boom 16 or to an extensible portion thereof, as shown. A hydraulic cylinder actuator 42 is connected to the boom and the positioning mechanism 36 for moving the positioning mechanism about the central axis of the pivot pin 38.

Figures 3, 13:
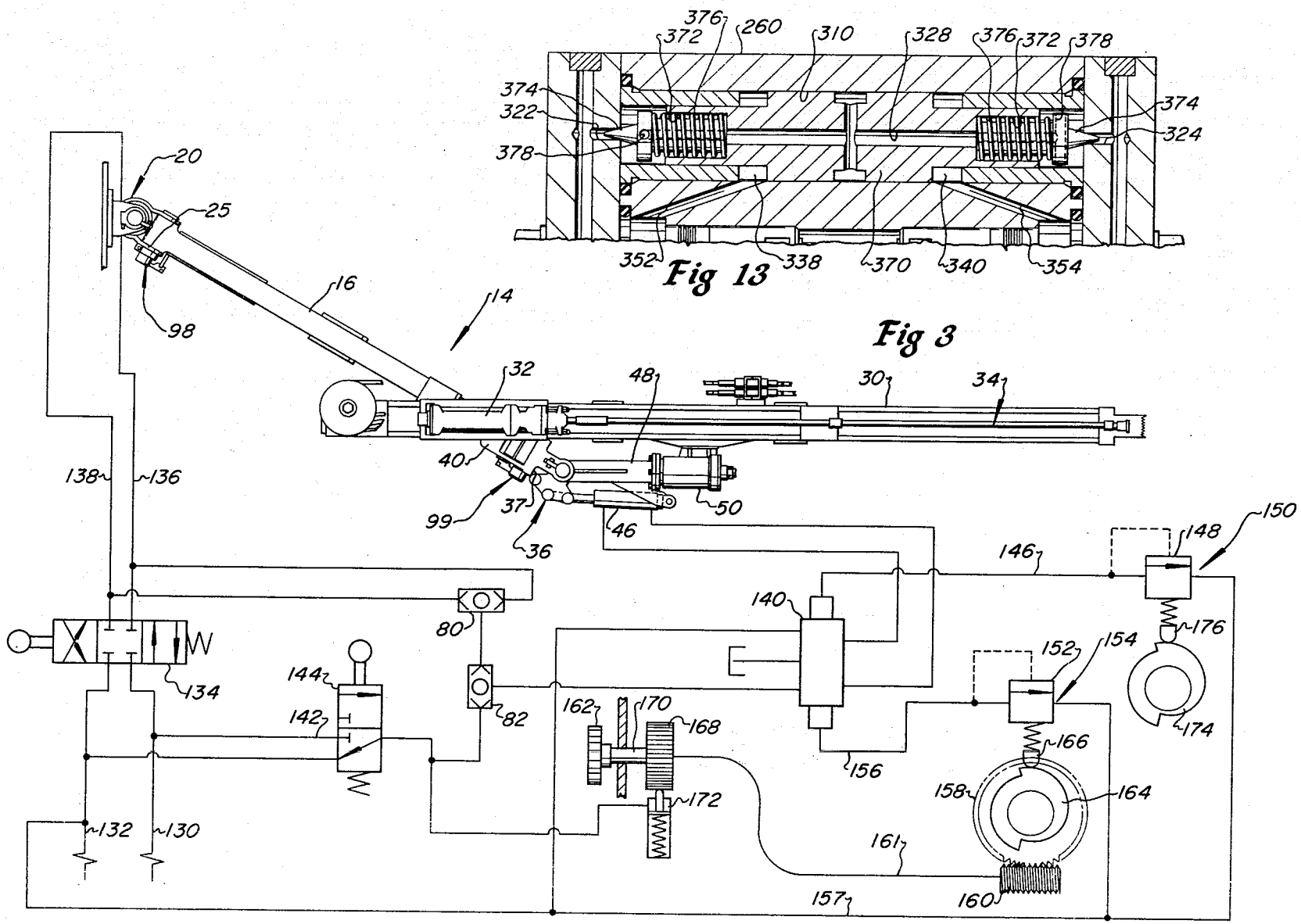
FIG. 3 is a plan view of the apparatus shown in FIG. 1 showing a diagram of another part of the control system.
FIG. 13 is a fragmentary section view of another embodiment of the pilot operated control valve.
Figure 7:
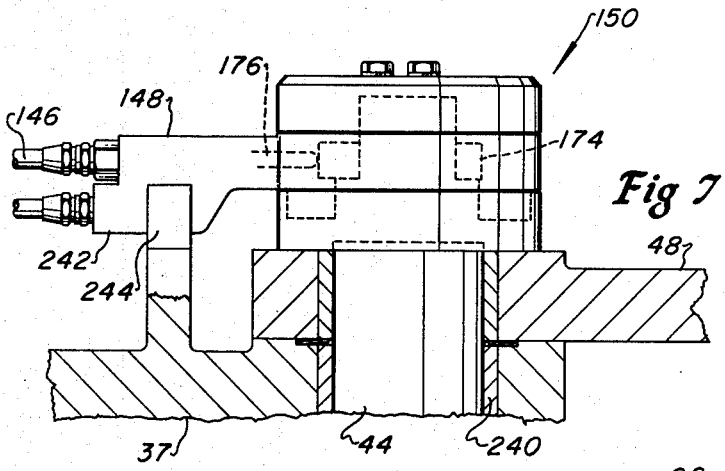
FIG. 7 is a side view of the position sensor mounted on the vertical pivot of the positioner mechanism with respect to the boom.

As shown in FIGS. 3 and 7 the positioning mechanism 36 is articulated and is adapted to swing the feed bar 30 with respect to the boom 16 about a vertical pivot axis formed by a pivot pin 44. A hydraulic cylinder actuator 46 is connected between the member 37 and a positioner arm 48 for moving the arm and the feed bar 30 with respect to the boom about the axis formed by the pin 44. The positioning mechanism 36 includes further mechanism including a rotary actuator 50 for rotating the feed bar 30 with respect to the remainder of positioning mechanism. The actuator 50 will not be discussed in detail here as it forms no part of the present invention.

Referring briefly to FIG. 2 the boom swing actuator 20 comprises a housing 52 which is mounted for rotation with respect to a stationary shaft 54. The shaft 54 is nonrotatably mounted on the spaced apart supports 22 and 24. The housing 52 contains an axially movable piston 56 which is formed with suitable helical splines 58 on the exterior of an integral rod portion of the piston. The splines 58 are interfitted in cooperating helical splines formed on a collar 60 within the interior of the housing 52. The piston 56 is formed to have internal helical splines 62 which are interfitted in cooperating helical splines 64 on the shaft 54. In response to pressure fluid being admitted to the chamber 66 or 68 the piston 56 is operable to move axially and rotatably to effect rotation of the housing 52 with respect to the longitudinal central axis of the shaft 54. Further details of the actuator 20 are disclosed in U.S. patent application Ser. No. 938,613 assigned to the assignee of the present invention. Other types of actuators including arrangements of cylinder and piston type actuators could be used in place of the actuator 20.

Referring to FIG. 1, the positioning control system of the present invention includes a control circuit for maintaining the directional attitude of the feed bar 30 parallel to a previous position when the boom 16 is moved about its horizontal pivot axis by the actuator 28. The control circuit includes a pump 70 for supplying pressure fluid to a directional control valve 72 which may be actuated by drill operating personnel at will to cause the actuator 28 to raise or lower the boom 16. Conduits 74 and 76 interconnecting the valve 72 and the actuator 28 are also connected to a pilot operated control valve 78 by way of shuttle valves 80 and 82 and a conduit 84. The control valve 78 thus receives pressure fluid from a pump supply conduit 86 by way of the valve 72 or by way of a second manually actuated valve 88. The valves 72 and 88 may be located at a drill operating control station, not shown. Pressure fluid is returned from the control valve 78 to a low pressure reservoir 89, as shown, by way of return conduits 90 and 92.

The pilot operated control valve 78, which is described hereinbelow in more detail with reference to FIGS. 9 through 12 is preferably a spool type valve which is operable to conduct pressure fluid to the positioner actuator 42 through either conduit 94 or 96 depending on the condition of position sensors located at the horizontal pivot connections between the boom 16 and the actuator 20, and the boom and the positioner mechanism 36, respectively. The position sensors are shown schematically in FIG. 1 and are generally designated by the numerals 98 and 99. The sensor 98 is located at the pivot connection between the boom 16 and the swing actuator 20 and the sensor 99 is located at the pivot connection between the boom and the positioner mechanism 36. The position sensor 99 comprises a generally circular cam 100 which is operable to rotate with the positioner mechanism 36 in response to operation of the actuator 42. The cam 100 is adapted to change the pilot fluid pressure in a conduit 102 by means of a pressure regulating valve 104 having an actuator comprising a cam follower 106 engaged with the cam 100.

The position sensor 98 is also provided with a generally circular cam 108 which is adapted to be fixed with respect to the clevis 25 on which the boom 16 is pivotally mounted to the swing actuator 20. The cam 108 is, however, operable to be rotated by a gear 110 in response to rotation of the gear by a worm gear 112. The worm gear 112 is connected to a control wheel 114 by a flexible rotary cable 116. The wheel 114 may be operated by the drill operator, at will, to change the rotational position of the cam 108 with respect to a cam follower 118 comprising an actuator for a pressure regulating valve 120. In the arrangement of the position sensor 98 the regulating valve 120 and its actuator comprising the cam follower 118 are operable to move with the boom 16 as it is pivoted with respect to the clevis 25. Conversely, movement of the boom 16 may be simulated by rotation of the cam 108 by the work gear 112.

The pressure regulating valve 120 is operable to regulate the pressure in a conduit 122 which is connected to the pilot actuator for the control valve 78. In response to movement of the boom 16 or rotation of the cam 108 by the gear 112 a change in pressure in conduit 122 occurs and the control valve 78 operates to conduct pressure fluid to the actuator 42. As the positioner mechanism 36 rotates with respect to the boom 16 in response to energization of the actuator 42 the cam 100 is rotated to change the pressure setting of the regulating valve 104. When the pressures in conduits 102 and 122, acting on the pilot actuator for the control valve 78 become equal or achieve a predetermined proportional relationship, the control valve 78 returns to a closed position and the pivotal movement of the feed bar 30 and the positioner mechanism 36 with respect to the boom stops. Accordingly, the angular movement of the positioner mechanism 36 and feed bar 30 may be controlled to coincide with the angular movement of the boom 16 with respect to the swing actuator 20. Moreover, the feed bar 30 may be moved independent of the movement of the boom 16 by changing the position of the cam 108 using the control wheel 114. In order to maintain the feed bar 30 parallel to its previous setting the direction of pivotal movement of positioning mechanism 36 will be opposite to that of the boom 16.

As shown in FIG. 1, the control wheel 114 is provided with a locking mechanism including a sprocket 124 fixed to the control wheel shaft 126 and a spring biased plunger 128 engageable with the sprocket. The plunger 128 is retracted by pressure fluid in response to actuation of the valve 88 to supply pressure fluid to the control valve 78. The locking mechanism for the control wheel 114 is intended to prevent accidental adjustment of the position of the cam 108 which could alter the directional attitude of the feed bar 30.

FIG. 3 illustrates the control circuit for controlling movement of the boom 16 about the rotational axis of the swing actuator 20 and movement of the feed bar 30 and positioner arm 48 with respect to the distal end of the boom. The control circuit is similar to the circuit shown in FIG. 1 and may include the pump 70 as a source of pressure fluid by way of conduits 130 and 132, shown in FIG. 1 also. The conduit 130 provides pressure fluid to a directional control valve 134 which is operable to conduct pressure fluid to the swing actuator 20 by way of conduits 136 and 138, alternatively, to provide swinging movement of the boom 16 in opposite directions. The control circuit shown in FIG. 3 also includes a pilot operated control valve 140 identical to the valve 78 and arranged to receive pressure fluid from either of the conduits 136 or 138 or a conduit 142 connected to a valve 144.

The pilot actuator for the control valve 140 is connected by way of conduit 146 to the pressure regulating valve 148 of a position sensor 150 which is adapted to be mounted at the pivot connection between the member 37 and the positioner arm 48. The pilot actuator of the control valve 140 is also connected to a pressure regulating valve 152 of a position sensor 154 by way of conduit 156. The regulating valves 148 and 152 are connected on their downstream sides to a fluid return conduit 157 in a manner similar to the regulating valves 104 and 120 shown in FIG. 1.

The position sensor 154 is similar to the position sensor 98 and includes a gear 158, a work gear 160, and a control wheel 162 for moving a cam 164 with respect to the regulating valve cam follower 166. The control wheel 162 may be mounted adjacent to the control wheel 114 and also near the valves 72, 88, 134 and 144 at the aforementioned operator control station, not shown.

The position sensor 154 is mounted at the pivot connection formed by the bracket 24 and the swing actuator 20. As is the case for the control circuit of FIG. 1 the position sensors 150 and 154 are shown in schematic form in the control circuit diagram for clarity.

The operation of the control circuit shown in FIG. 3 is similar to the circuit shown in FIG. 1. When the valve 134 is operated to cause the swing actuator 20 to pivot the boom 16 in one direction or the other the angle of swing of the boom is duplicated in the opposite sense by pivotal movement of the positioner arm 48 and the feed bar 30 with respect to the member 37 and the boom bracket 40. Accordingly, the feed bar 30 may be maintained in a predetermined directional altitude regardless of the swing position of the boom so that a pattern of parallel holes may be drilled in a workface. The feed bar 30 may be moved independently of the swing movement of the boom by operation of the control wheel 162 to rotate gear 158 and cam 164 by way of the flexible cable 161 and worm gear 160. The control wheel 162 is also provided with a locking mechanism comprising a sprocket 168 mounted on the control wheel shaft 170 and engageable with a spring biased plunger 172. The plunger 172 is retractable to release the control wheel 162 when the valve 144 is opened to supply pressure fluid to the control valve 140.

The position sensor 150 includes a cam 174 which is suitably fixed to the pivot pin 44, FIG. 7, which pin rotates with the arm 48, and with respect to the member 37. Accordingly, when the cam 174 is rotated in response to energization of the actuator 46 the cam follower 176 operates to change the setting of the pressure regulating valve 148 until the pressure in the conduit 146 equals the pressure in conduit 156 or until the valve 140 reaches a force balanced and closed condition.

It will be appreciated from the foregoing that the operation of the control circuits shown in FIGS. 1 and 3 are virtually identical, the main differences being the actuators controlled by the respective directional control valves 72 and 134 and the pilot operated control valves 78 and 140, and the location of the respective position sensors.

Figure 4:
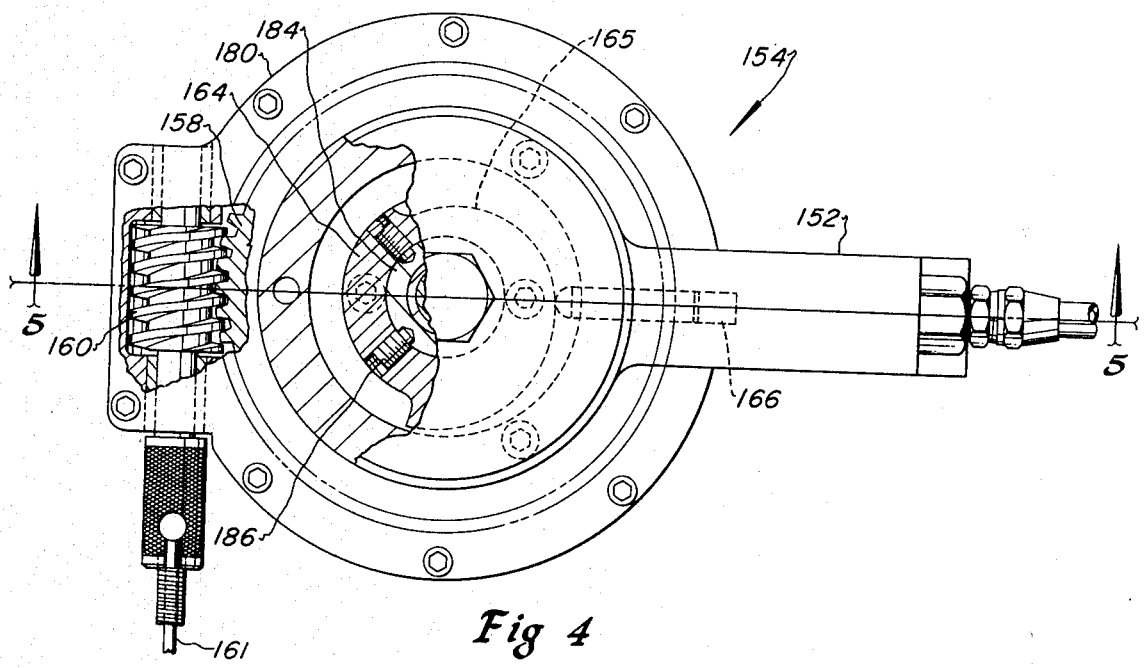
FIG. 4 is a top view of the position sensor mounted on the vertical pivot of the drill boom.
Figure 5:
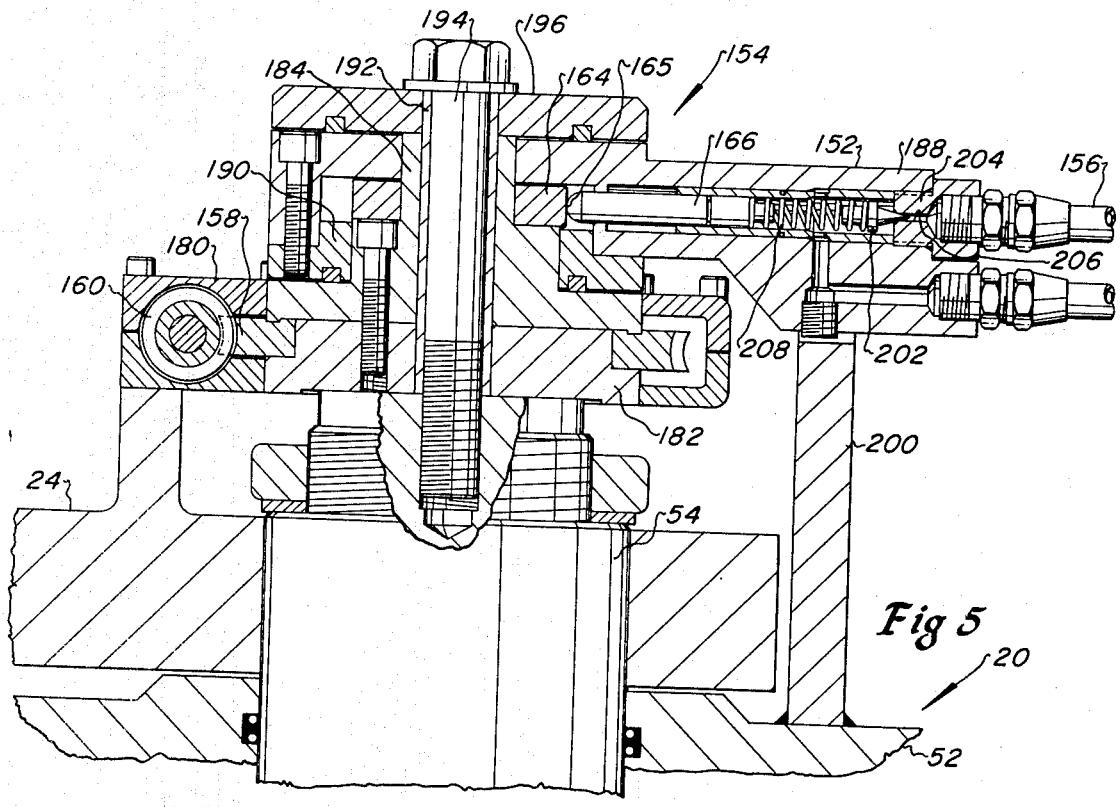
FIG. 5 is a section view taken from line 5—5 of FIG. 4.

Referring to FIGS. 4 and 5 the structural details of the position sensor 154 are illustrated. The construction of the sensor 154 and 98 are substantially the same, the only difference being essentially the mounting location. The sensor 154 includes a housing 180 which is fixed to the bracket 24 and thus is stationary. The housing 180 rotatably supports the worm gear 160 and also encloses the gear 158. The worm gear 160 is suitably connected to the flexible cable 161 which as described hereinabove leads to control wheel 162, not shown in FIG. 4. The gear 158 includes a hub 182 which is disposed on the end of the stationary shaft 54. A cam support plate 184 is fastened to the gear hub 182 and supports the cam 164 which is removably secured to the support plate by radial projecting screws 186. The cam 164 includes a curved cam surface 165 which has a continuously varying radial distance from the central axis of rotation of the cam follower 166 with respect to the cam. The sensor 154 also includes a housing 188 for the pressure regulating valve 152. The housing 188 includes a separable bearing member 190 rotatably journalled on the cam support plate 184. The gear hub 182 and the cam support plate 184 are journalled on a tubular bushing 192 through which a mounting bolt 194 projects to secure the sensor 154 to the stationary shaft 54. A cover member 196 is disposed over the housing 188 and is also retained in assembly with the other parts by the bolt 194.

The housing 188 for the pressure regulating valve 152 is suitably secured to a post 200 which projects upwardly from the top of the housing 52 of the swing actuator 20. Accordingly, the housing 188 is operable to rotate with the swing actuator 20 and relative to the cam 164. The cam 164, of course, remains stationary except when being repositioned by rotation of the gear 158.

The pressure regulating valve 152 includes a closure member 202 which is engageable with a valve seat 204 having a passage 206 therein in communication with the fluid conduit 156. The closure member 202 is biased toward the seat 204 by a coil spring 208 interposed between the closure member and the cam follower 166. The cam follower 166 is slidably disposed in the housing 188 and engages the cam 164. In response to relative movement of the cam follower 166 with respect to the cam 164 about the axis of rotation of the swing actuator 20 the biasing force of the spring 208 is changed due to the compression or extension thereof and accordingly the fluid pressure in the passage 206 and conduit 156 may be controlled in accordance with the rotation of the boom 16.

Figure 6:
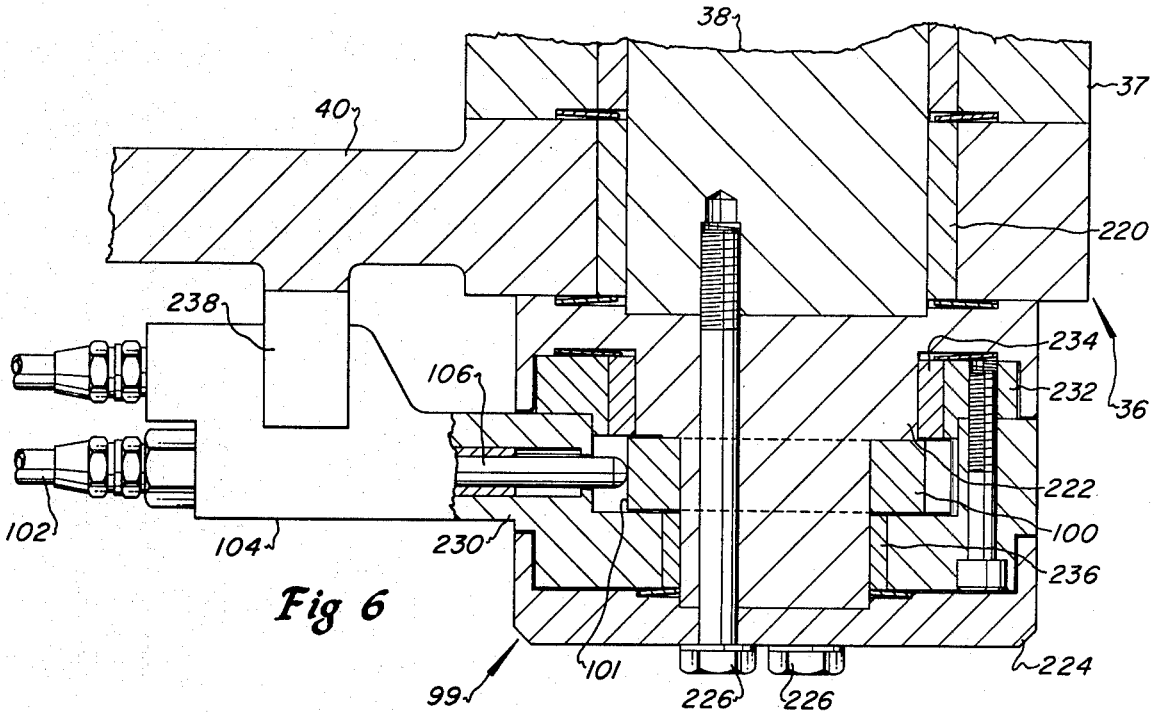
FIG. 6 is a section view of the position sensor mounted on the horizontal pivot of the feed bar positioner mechanism.

FIG. 6 is a section view showing the mounting arrangement of the position sensor 99, which senses the angular movement of the positioner mechanism 36, including the member 37, and the feed bar 30 with respect to the clevis bracket 40. A portion of the clevis bracket 40 and the positioner member 37 are shown in FIG. 6 The pivot pin 38 is suitably secured to the member 37 and is disposed in bearings 220, one shown, for rotation with respect to the clevis bracket 40. The sensor 99 includes a cam support plate 222 on which cam 100 is mounted for rotation with the support plate. The support plate 222 and a cover member 224 are secured together and to the pivot pin 38 by fasteners 226.

The sensor 99 further includes a housing 230 for the pressure regulating valve 104. The regulating valve 104 is essentially identical to the valve 152 and is operable to control the fluid pressure in conduit 102. The housing 230 includes a separable flange member 232 and is supported on the cam support plate 222 by bushings 234 and 236. The housing 230 is also connected to an arm 238 fixed to the clevis bracket 40. Accordingly, in the arrangement of the position sensor 99 the cam 100 rotates with the pin 38 and the positioner bracket 37 and with respect to the boom clevis bracket 40. The cam follower 106 traverses the surface 101 of the cam 100 as the cam rotates to effect a change of the regulated pressure in conduit 102 by means of the regulating valve disposed in the housing 230.

Referring to FIG. 7, a side view is shown of the sensor 150 for the vertical pivot connection between the positioner arm 48 and the bracket 37. The sensor 150 is of substantially the same construction as the sensor 99 and is arranged to have its cam fixed to the pivot pin 44. The pivot pin 44 is fixed to the positioner arm 48 and rotates in a suitable bearing 240 in the member 37. The housing 242 for pressure regulating valve 148 is secured against rotation with respect to the member 37 by the post 244 projecting from the member. The sensor 150, of course, senses the angular movement of the positioner arm 48 and movement of the positioner arm 48 and the feed bar 30 about the central axis of the pin 44 and transmits a fluid pressure signal to the control valve 140 proportional to the angular movement.

Figure 8:
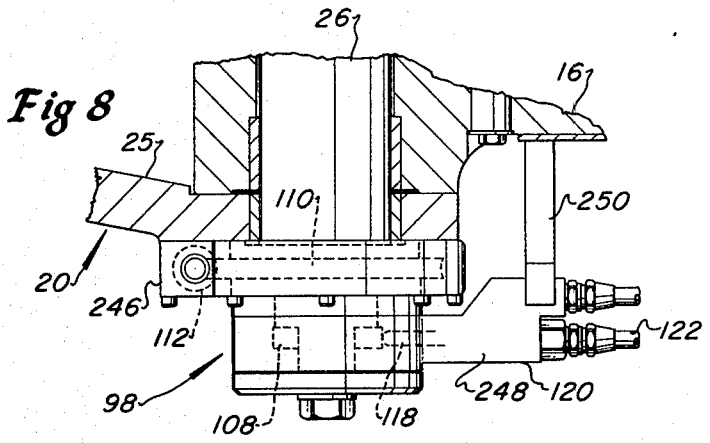
FIG. 8 is a side view of the position sensor mounted on the horizontal pivot of the drill boom.

FIG. 8 illustrates a side view of the position sensor 98 which is disposed at the horizontal pivot connection between the boom 16 and the swing actuator 20. The sensor 98 is substantially the same as the sensor 154 and includes a worm gear housing 246 fixed to the clevis 25 of the swing actuator 20. The pressure regulator valve housing 248 of the sensor 98 is connected to a postlike projection 250 on the boom 16 so that the pressure regulating valve 120 and its associated cam follower 118 rotate with the boom about the central axis of pivot pin 26. Accordingly, the cam 108 is normally nonrotatable with respect to the pin 26 and the pin 26 is nonrotatably fixed to the clevis 25. The cam 108 can, of course, be rotated by its worm gear mechanism as described above for the sensor 154.

Figure 9:
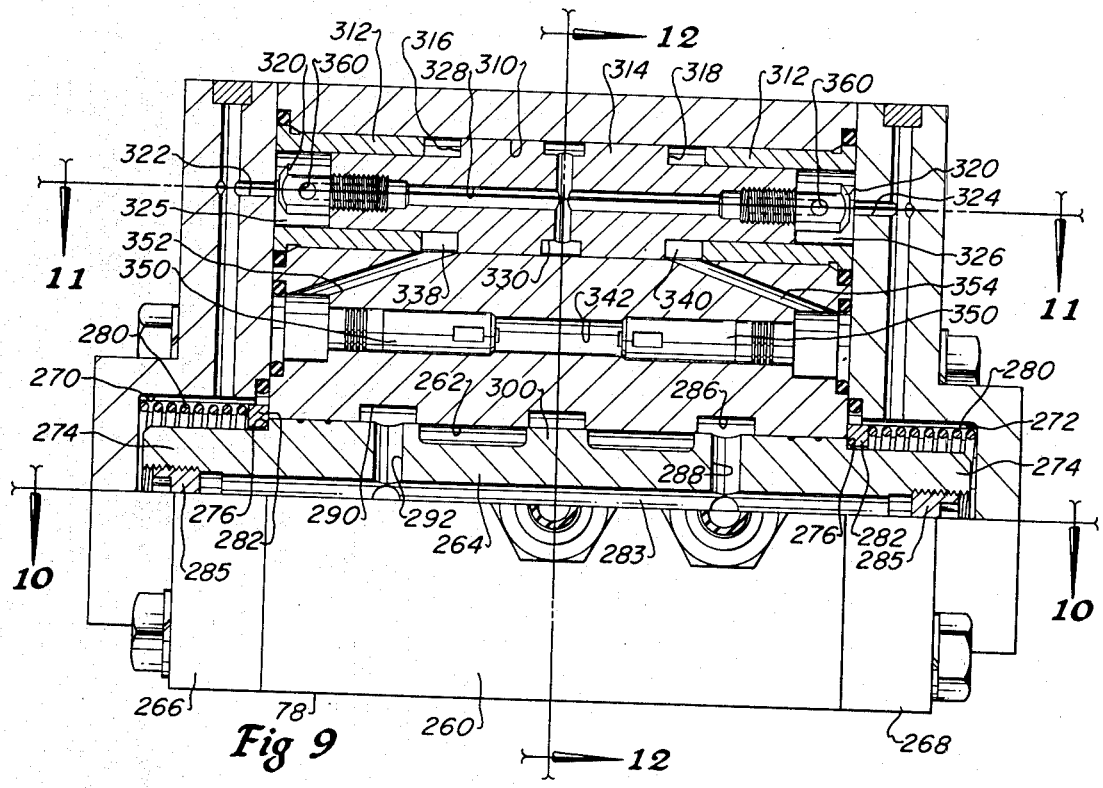
FIG. 9 is a longitudinal side elevation, partly in section, of a pilot operated control valve used with the control system of the present invention.
Figure 10:
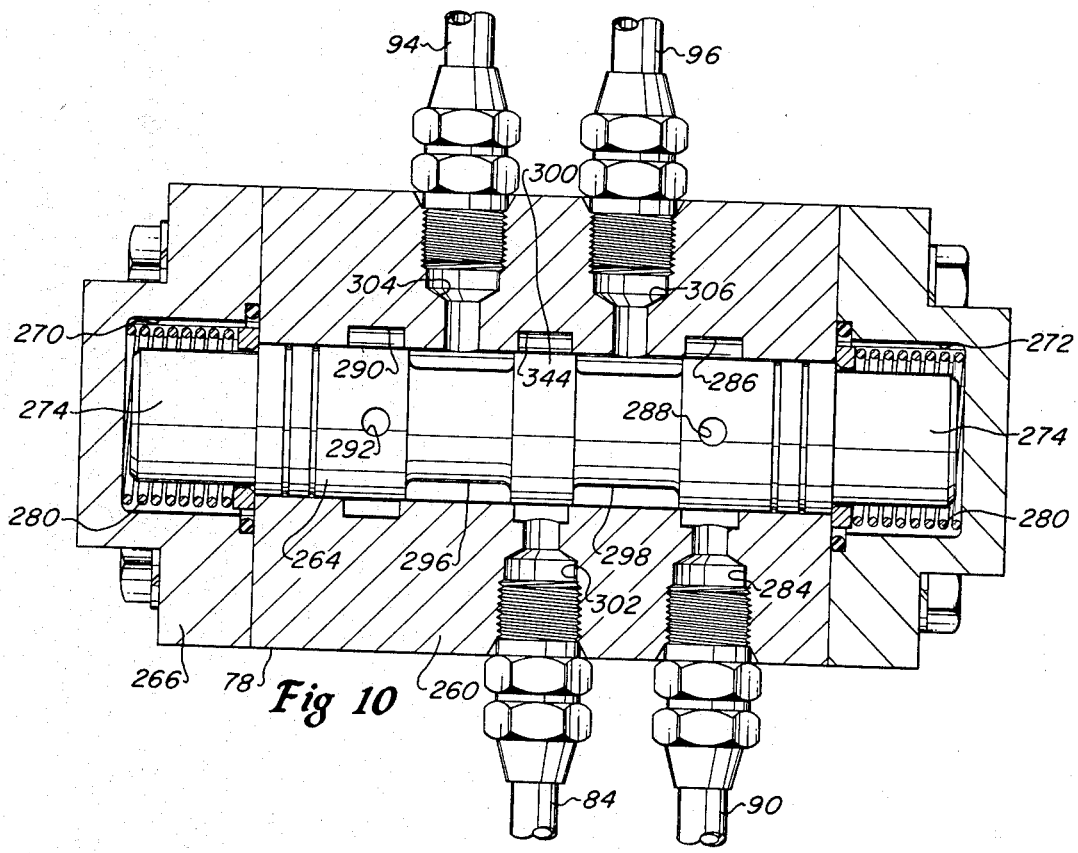
FIG. 10 is a section view taken from line 10—10 of FIG. 9.

An important part of the present invention is embodied in the improved pilot operated control valves 78 and 140 which are used in the circuits shown in FIGS. 1 and 3. The control valve 78 is shown in detail in FIGS. 9 through 12 of the drawings. The control valve 140 is identical to the valve 78 so a detailed description is not believed to be necessary. Referring to FIGS. 9 and 10 the control valve 78 includes a body 260 having an elongated bore 262 in which a spool 264 is disposed in close fitting but slidable relationship to the bore wall. The valve 78 also includes a pair of end covers 266 and 268 removably fastened to the body 260 and forming respective cavities 270 and 272 adjacent to the bore 262. The spool 264 includes opposed projections 274 disposed in the cavities 270 and 272. The projections 274 are of a smaller diameter than the main body of the spool and thereby form opposed transverse shoulders 276. Coil springs 280 are disposed in each of the cavities 270 and 272 and engage respective collar 282 which bear against the shoulders 276 and the respective side walls of the body 260 as shown in FIG. 9. Accordingly, the springs 280 operate to center the spool 264 in the body 260 in the absence of any unbalanced fluid pressure in the cavities 270 or 272.

The spool 264 includes a central closed end passage 283 which is arranged to be in communication with a fluid return port 284 by way of an annular recess 286 in the body 260 and a passage 288. The passage 283 is also in communication with a second annular recess 290 by way of a passage 292. Both recesses 286 and 290 are always in communication with the fluid return port 284 and the fluid therein is normally maintained at a relatively low pressure which is the fluid system return pressure, for example, about 1825KPa. In the circuit of FIG. 1 the port 284 is in communication with return conduit 90.

Referring to FIG. 10 the spool 264 includes recesses 296 and 298 separated by an interposed land 300. The recesses 296 and 298 provide for interconnecting a pressure fluid inlet port 302 with ports 304 and 306, respectively. The ports 304 and 306 are in communication with the respective conduits 94 and 96 connected to the actuator 42 in the circuit of FIG. 1 or in the case of the circuit of FIG. 2, the equivalent ports of the valve 140 are connected to the respective conduits leading to the actuator 46. When an unbalanced pressure force caused by pressure in the cavity 272 moves the valve spool to the left, viewing FIG. 10, pressure fluid is supplied to the actuator 42 by way of port 306, and fluid is returned from the actuator through port 304 and to port 284 by way of recesses 296 and 290, passages 292, 283, and 288 and recess 286. When an unbalanced pressure force acting on the spool 264 due to pressure in cavity 270 moves the spool to the right, ports 302 and 304 are interconnected by way of recess 296, and the ports 284 and 306 are in flow communication with each other through recess 298.

The movement of the valve spool 264 is controlled by an improved pilot actuator mechanism which is responsive to relatively small changes in fluid pressure in the conduits leading to the position sensors. Of course, the position sensors disclosed herein are exemplary and other arrangements may be adapted for providing fluid pressure signals to the pilot actuator mechanism described hereinbelow.

Figure 11:
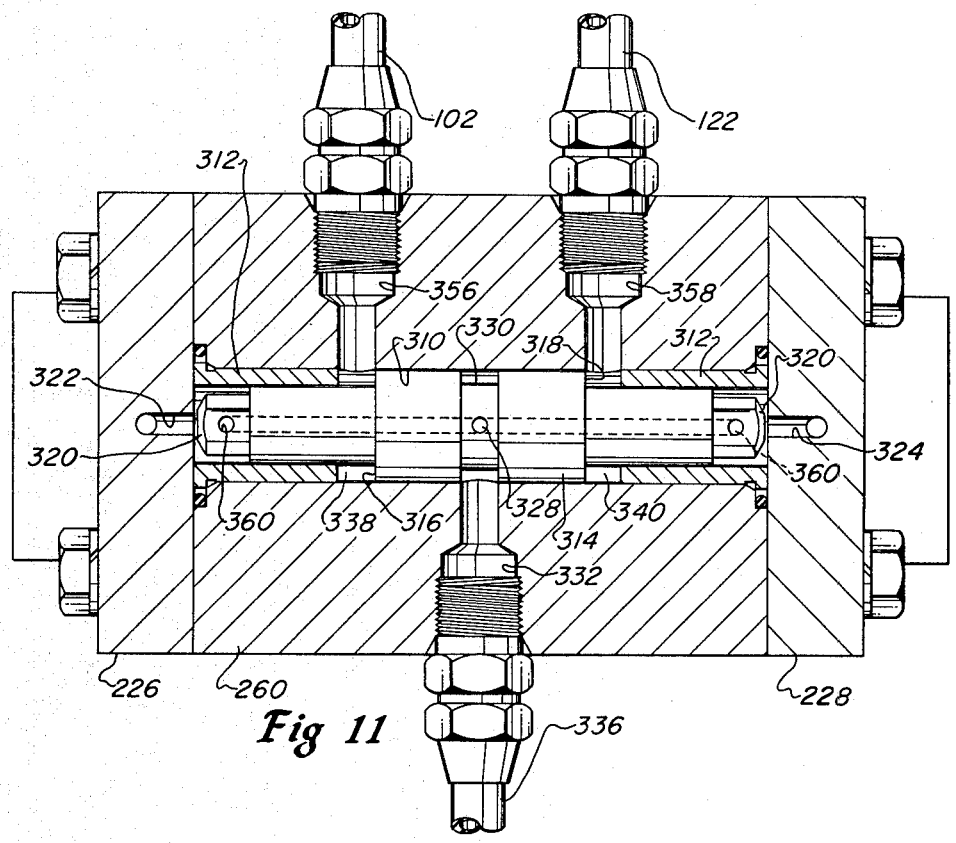
FIG. 11 is a section view taken from line 11—11 of FIG. 9.

Referring again to FIG. 9 and also to FIG. 11, the valve body 260 includes a second elongated bore 310 in which are disposed opposed tubular sleeves 312, as shown. The bore 310 also contains an elongated piston 314 having opposed transverse pressure surfaces 316 and 318 formed adjacent to respective oppositely extending portions of the piston which are closely fitted in the sleeves 312. The piston 314 is also provided with a pair of removable heads 320 threadedly mounted in each end face of the piston and normally disposed closely adjacent, respectively, to end walls 321 and 323. The passages 322 and 324 open through the end walls 321 and 323 and are respectively in communication with the cavities 270 and 272. The piston heads 320 are disposed in respective chambers 325 and 326 and include internal passage means which are in communication with a longitudinal passage 328 in the piston 315. The passage 328 is in communication with an annular groove 330 in the piston 314 which at all times is in communication with a port 332 in the body 260, FIG. 12. The port 332 is in communication with a low pressure reservoir 334 by way of a conduit 336 as shown in the circuit diagram of FIG. 1. The pressure in the conduit 336 is normally considerably less than the pressure in the cavities 270 and 272 in order for the valve 78 to function properly.

Figure 12:
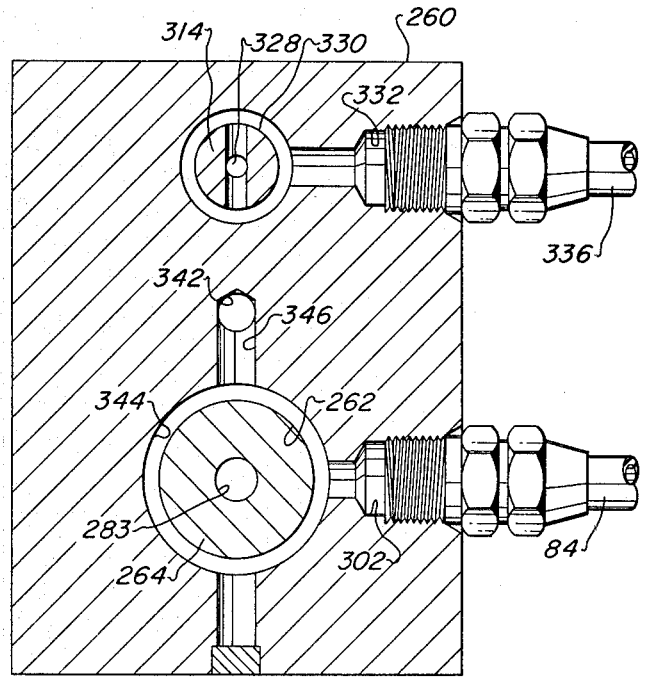
FIG. 12 is a section view taken from line 12—12 of FIG. 9.

The control valve 78 also includes means for supplying pressure fluid to chambers 338 and 340 which are formed between the respective opposed piston faces 316 and 318 and the tubular sleeves 312. Referring to FIGS. 9 and 12, the valve body 260 includes a passage 342 which is always in communication with the inlet port 302 by way of an annular recess 344 in the bore 262 and a connecting passage 346. The passage 342 is also in communication with the chambers 338 and 340 by way of a pair of opposed flow control devices 350 which are arranged oppositely facing in the passage 342 on each side of the connecting passage 346. The flow control devices 350 are generally known as pressure compensated fixed flow controls which are operable to provide a predetermined fixed fluid flow rate to the chambers 338 and 340 by way of respective passages 352 and 354 regardless of pressure variations in the chambers or in the passage 342. The flow control devices 350 are commercially available and one source of such a device is the Lee Company, Westbrook, Conn., U.S.A.

The fluid supplied to the chambers 338 and 340 from the flow control devices 350 is conducted to the position sensor pressure regulating valves by way of respective ports 356 and 358. In the circuit shown in FIG. 1, for example, the ports 356 and 358 are in communication with the respective conduits 102 and 122 leading to the pressure regulating valves 104 and 120. In the circuit diagram of FIG. 3 the control valve 140 has its equivalent ports respectively in communication with conduits 146 and 156 leading to the regulating valves 148 and 152.

When pressure fluid is supplied to the inlet port 302 of the valve 78 and the pressure regulating valve 104 and 120 are controlling the pressure in the respective conduits leading thereto to be equal, the pilot actuator piston 314 will be centered in the bore 310 as shown in FIGS. 9 and 11. In this position of the piston 314 the heads 320 are disposed approximately equidistant from the respective passages 322 and 324 in the valve covers with a relatively small clearance of from 0.075 mm to 0.125 mm. Fluid is supplied to the cavities 270 and 272 by leakage flow from the recesses 290 and 286, respectively, and between the valve spool 264 and the wall of the bore 262. Alternatively, fluid could be supplied to the cavities 270 and 272 by orifices in plugs 285 disposed in each end of the passage 283. This leakage flow leaves the cavities 270 and 272 through the respective passage 322 and 324, passage means 360 in the heads 320, and finally through the passage 328 to the drain port 332. However if, for example, the pressure in chamber 340 increases in accordance with relative movement of the cam follower of the position sensor 98, in the case of the circuit shown in FIG. 1, which movement would result from movement of the boom 16 by actuator 28, the piston 314 will shift to cause the head 320 to close off the passage 322. Accordingly, the pressure in the cavity 270 will increase in relation to the pressure in cavity 272 and cause the spool 264 to move to a position permitting the ports 302 and 304 to be connected by way of the recess 296. Moreover, the port 284 under the same conditions, will be placed in communication with the port 306 through the recess 298. When the spool 264 is moved out of the centered position shown in FIGS. 9 and 10 in the opposite direction in response to relative movement of the position sensor cam follower in the opposite direction and the change in fluid pressure caused thereby, pressure fluid may be conducted from port 284 to port 306, also to operate the positioning actuator 42 to which the valve 78 is connected.

When the position sensor 99 responds to movement of the positioner mechanism 36 the cam 100 will cause the pressure regulating valve 104 to change the pressure in chamber 338 of control valve 78 causing said pressure to approach the fluid pressure in the chamber 340. As the pressure in chamber 338 becomes equal to the pressure in chamber 340 and then very slightly exceeds the pressure in chamber 340 the piston 314 will move back toward the centered position progressively uncovering the passage 322 and relieving the increased pressure in cavity 270 thereby allowing the springs 280 to move the valve spool 264 to the centered position. Of course, if the pressure signal is reduced in chamber 340 then the piston 314 will shift in the opposite direction to that described above blocking the passage 324 and causing the valve spool 264 to move in the opposite direction also.

Because of the small mass of the piston 314 and the short strokes required to block or unblock the passages 322 and 324 the movement of the main valve spool 264 is very responsive to small changes in pressure caused by the position sensors. Moreover, the tendency for the valve 78 to "hunt" or cause overtravel of the actuator controlled thereby is minimized.

An alternate embodiment of the pilot operated control valve 78 is shown in FIG. 13. The fragmentary section view of FIG. 13 includes the only part of the control valve which differs from the embodiment of FIGS. 9 through 12. In the embodiment shown in FIG. 13 a modified piston 370 is disposed in the bore 310 in place of the piston 314. The piston 370 includes a pair of opposed recesses 372 in which are respectively disposed closure members 374. The closure members 374 are biased to the positions shown in FIG. 13, closing off the passages 322 and 324, by springs 376 disposed in the recesses 372. The closure members 374 are provided with passage means 378 operable to be in communication with the passage 328 at all times. In response to movement of the piston 370 in one direction or the other the bias force is reduced on the closure member which is opposite to the direction of movement of the piston and the fluid pressure in the chamber 270 or 272 associated with that closure member is reduced accordingly to effect movement of the spool 264.

What is claimed is:

1. In a rock drill apparatus a drill boom mounted on a boom support for pivotal movement about a first pivot axis, an elongated drill feed bar mounted on said boom for pivotal movement with respect to said boom about a second pivot axis, a rock drill mounted on said feed bar and adapted to actuate an elongated drill stem, a first boom actuator for moving said boom pivotally about said first axis, a first feedbar actuator for effecting pivotal movement of said feed bar about said second axis, said first boom actuator and said first feed bar actuator being pressure fluid operated, a pressure fluid control circuit including a source of pressure fluid, valve means operable at will to cause said first boom actuator to move said boom about said first axis, a control valve for supplying pressure fluid to said first feed bar actuator, means including a first sensing device comprising a cam and a cam follower which are relatively moveable in response to pivotal movement of said boom to cause said control valve to effect a predetermined amount of pivotal movement of said feed bar about said second axis in response to movement of said boom about said first axis, and means for producing relative movement between said cam and said cam follower to cause said control valve to effect pivotal movement of said feed bar about said second axis independent of movement of said boom about said first axis said means for producing relative movement between said cam and said cam follower, includes a gear connected to said cam and adapted to rotate said cam with respect to said cam follower, and gear operating means for rotating for said gear and said cam at will to effect pivotal movement of said feed bar by the operation of said control valve.

2. The invention set forth in claim 1 wherein:

said first sensing device includes a pressure regulating valve actuated by said cam follower and responsive to the pivotal movement of said boom for generating a fluid pressure signal which varies with the amount of angular movement of said boom.

3. The invention set forth in claim 2 together with:

a second sensing device including a pressure regulating valve responsive to the pivotal movement of said feed bar about said second axis for generating a fluid pressure signal which varies with the amount of angular movement of said feed bar about said second axis.

4. The invention set forth in claim 1 wherein:

said gear operating means includes pressure fluid actuated locking means and said control circuit includes a manually actuated fluid supply valve in communication with said pressure fluid source and operable to supply pressure fluid to said control valve and said locking means to unlock said gear operating means when said feed bar is to be moved independently of the movement of said boom.

5. The invention set forth in claim 1 wherein: said gear operating means includes means disposed on said apparatus remote from said first sensing device and operable at will to rotate said gear and said cam to cause said control valve to effect pivotal movement of said feed bar.

* * * * *

UNITED STATES PATENT AND TRADEMARK OFFICE

CERTIFICATE OF CORRECTION

PATENT NO. : 4,267,892

DATED : May 19, 1981

INVENTOR(S) : James R. Mayer

It is certified that error appears in the above-identified patent and that said Letters Patent are hereby corrected as shown below:

Column 1, line 64, "values" should be --valves--.

Column 11, line 25, "for" (second occurrence) should be deleted.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*